US011619021B2

(12) United States Patent
Karl et al.

(10) Patent No.: US 11,619,021 B2
(45) Date of Patent: Apr. 4, 2023

(54) CONSTRUCTION DEVICE AND METHOD FOR OPERATING A CONSTRUCTION DEVICE

(71) Applicant: BAUER Spezialtiefbau GmbH, Schrobenhausen (DE)

(72) Inventors: Herbert Karl, Osterham (DE); Robert Kulzinger, Hollenbach (DE); Josef Stöckl, Pessenburgheim (DE)

(73) Assignee: BAUER Spezialtiefbau GmbH, Schrobenhausen (DE)

( * ) Notice: Subject to any disclaimer, the term of this patent is extended or adjusted under 35 U.S.C. 154(b) by 398 days.

(21) Appl. No.: 16/763,941

(22) PCT Filed: Apr. 30, 2019

(86) PCT No.: PCT/EP2019/061050

§ 371 (c)(1),
(2) Date: May 13, 2020

(87) PCT Pub. No.: WO2019/242921

PCT Pub. Date: Dec. 26, 2019

(65) Prior Publication Data

US 2020/0385948 A1 Dec. 10, 2020

(30) Foreign Application Priority Data

Jun. 18, 2018 (EP) ..... 18178253

(51) Int. Cl.
*E02D 13/04* (2006.01)
*E21B 7/02* (2006.01)
(Continued)

(52) U.S. Cl.
CPC ..... *E02D 13/04* (2013.01); *E02D 7/16* (2013.01); *E02D 7/165* (2013.01); *E02D 17/13* (2013.01);
(Continued)

(58) Field of Classification Search
CPC .. E02D 13/04; E02D 7/02; E02D 7/06; E02D 7/14; E02D 7/16; E02D 7/165; E02D 7/18; E02D 7/22; E21B 7/02; E21B 15/00
See application file for complete search history.

(56) References Cited

FOREIGN PATENT DOCUMENTS

AU 2019203148 A1 * 11/2019
CN 2296367 Y 11/1998
(Continued)

OTHER PUBLICATIONS

International Preliminary Report on Patentability issued in PCT/EP2019/061050; completed Dec. 12, 2019.
(Continued)

*Primary Examiner* — Frederick L Lagman
(74) *Attorney, Agent, or Firm* — Studebaker & Brackett PC

(57) ABSTRACT

The invention relates to a construction device and to a method for operating this construction device, comprising a carrier device, an approximately vertical mast, which is mounted on the carrier device, a movement element, which is vertically movable along a linear guide on the mast, and at least one GPS receiving unit, which is arranged in the region of the mast. According to the invention, it is provided that the at least one GPS receiving unit is attached to the movement element and that the at least one GPS receiving unit can be moved between an upper, first measuring position and a lower, second measuring position by means of the movement element.

9 Claims, 4 Drawing Sheets

(51) Int. Cl.

| | |
|---|---|
| ***E21B 15/00*** | (2006.01) |
| ***E02D 7/16*** | (2006.01) |
| ***E02D 17/13*** | (2006.01) |
| *E02D 7/12* | (2006.01) |

(52) U.S. Cl.
CPC ..... *E21B 7/02* (2013.01); *E21B 15/00* (2013.01); *E02D 7/125* (2013.01)

(56) References Cited

FOREIGN PATENT DOCUMENTS

| | | | | | |
|---|---|---|---|---|---|
| CN | 106120786 | A | * | 11/2016 | ..... A01G 17/16 |
| CN | 106284351 | A | | 1/2017 | |
| EP | 2775089 | A1 | | 9/2014 | |
| EP | 3296467 | A1 | | 3/2018 | |
| ES | 2751753 | A1 | * | 4/2020 | ..... A01G 17/16 |
| GB | 2422389 | A | | 7/2006 | |

OTHER PUBLICATIONS

An Office Action mailed by China National Intellectual Property Administration dated Dec. 20, 2021, which corresponds to Chinese Patent Application No. 201980006585.9 and is related to U.S. Appl. No. 16/763,941; with English language translation.
International Search Report issued in PCT/EP2019/061050; dated Jul. 29, 2019.

* cited by examiner

CONSTRUCTION DEVICE AND METHOD FOR OPERATING A CONSTRUCTION DEVICE

The invention relates to a construction device comprising a carrier device, an approximately vertical mast, which is mounted on the carrier device, a movement element, which is vertically movable along a linear guide on the mast, and at least one GPS receiving unit, which is arranged in the region of the mast. The invention further relates to a method for operating a construction device of this kind.

Such construction devices have long been known, for example, as drilling devices for constructing foundation piles in the ground. For determining a position of the drilling device, it is known to equip said device with a GPS system. Here, a GPS antenna is usually located on a mast head. Here, the GPS antenna generally extends vertically upwards, with the raised position allowing for the best possible GPS positioning.

At the same time, by positioning a GPS receiving unit in the upper mast region in this way, the determination of the position of the drilled hole made in the ground can also be done. In a drilling device, a drilling drive comprising a drilling tool is guided along the mast in a linearly movable manner.

However, drilling devices often comprise a mast having a mast height of 20 m or more. Owing to the height of this mast and to an unavoidable play of the pivot bearings relative to the carrier device, shifts of a GPS antenna on the upper end of the mast may be resulted by several cm relative to a drilled hole made in the ground. When constructing so-called bored pile walls, during which a plurality of bored piles has to be constructed close together with a defined overlap, such measurement fluctuations may, for example, result in accordingly larger overlap regions having to be provided between adjacent bored piles in order to compensate for these measurement fluctuations. This results in an increased material consumption and in the construction of a greater number of bored piles for bored pile walls to be constructed.

This problem is dealt with by the generic document EP 3 296 467 A1, which discloses a drilling device comprising a mast to which a GPS antenna is attached. In order to determine keep-off distances, a measuring apparatus is additionally arranged on a carrier device, by means of which a spacing between the drilling tool and the carrier device can be identified.

The invention is based on the object to provide a construction device and a method for operating a construction device, in which, with the simplest possible structure, a particularly good positioning by means of a GPS system can be facilitated.

The construction device according to the invention is characterized in that the at least one GPS receiving unit is attached to the movement element and in that the at least one GPS receiving unit can be moved between an upper, first measuring position and a lower, second measuring position by means of the movement element.

A basic concept of the invention can be considered in that to mount the GPS receiving unit on the mast movably between vertically differing measuring positions. Essential advantages result from the fact that, in a system that is extended upwards, the drilling point can be approached. In this case, the at least one GPS receiving unit is arranged as far up as possible on the construction device such that, in closely built areas, a good signal quality can be achieved.

To detect the position of the element to be constructed, for example of a foundation pile or an element to be piled, it is advantageous for the at least one GPS receiving unit to be arranged as close as possible to the surface of the ground. As a result, an increased measuring accuracy can be achieved with the existing GPS receiving unit without an additional measuring apparatus necessarily being required. By moving the GPS receiving unit downwards along the mast, inaccuracies are also decreased which are caused by mast deflections and bearing play.

According to a development of the invention, an increase in the measuring accuracy can be achieved by a plurality of GPS receiving units being arranged. It is particularly advantageous here for two GPS receiving units to be provided, which are arranged on opposite sides of the movement element. Arranging a plurality of GPS receiving units makes it possible to compensate for measurement inaccuracies of individual receiving units, such that a very precise measurement can be achieved overall.

According to an embodiment of the invention, it is particularly expedient for the at least one GPS receiving unit to comprise an antenna holder extending approximately horizontally away from the movement element, at the free end of which holder a receiving element is arranged spaced apart from the movement element. In this case, the receiving element may be just one antenna or the GPS receiving unit comprising corresponding electronics. Spacing the GPS receiving unit apart from the movement element allows for an improved signal reception.

It is particularly advantageous here that the antenna holder comprises a first bar-shaped portion and a second bar-shaped portion, which are arranged angled with an obtuse bend angle relative to one another. In this case, the bend angle is preferably formed in a horizontal direction such that the GPS receiving unit is directed forwards away from the mast.

In principle, the movement element, which is mounted movably along the mast, may be a separate slide or preferably a working slide that is already provided on the mast, for example for a drilling drive. According to a development of the invention, it is particularly expedient for the movement element to be a beam-shaped leader element and for the at least one GPS receiving unit to be attached in an upper region of the leader element. A leader is essentially a mast built-up in two parts comprising a main mast on which a vertical beam-shaped leader element is mounted vertically movable along the main mast. Another linear guide can be provided on the beam-shaped leader element itself, along which guide a working slide is movably mounted. Preferably, the at least one GPS receiving unit is attached at the upper end of the leader element.

A development of the invention consists in that the leader element comprises a linear slide guide on a front side facing away from the mast, and in that a slide is provided which is mounted vertically movably along the slide guide of the leader element. The slide may, in principle, be a working slide for receiving a construction-work device. In principle, at least one GPS receiving unit could be provided on this slide. Preferably, however, the slide does not have a GPS receiving unit, with said unit being arranged on the movable leader element. The arrangement on the leader element ensures that the sensitive GPS receiving units have a certain spacing from the working point on the ground in the downward moved measuring position, too, in order to protect the GPS receiving unit.

According to a variant of the invention, it is particularly preferred for a working device, in particular a drilling drive, a vibration hammer or a piling unit, to be arranged on the slide. The drilling drive is in particular a hydraulic drive, as is used in a known manner to drive a drill pipe, a continuous flight auger, a drilling bucket, etc., for constructing a drilled hole in the ground. A vibration hammer is a working device comprising a plurality of driven unbalance units in order to generate a targeted vibration which is used, for example, to drive a pile, a board, or a support into the ground. The piling unit may, for example, be a diesel hammer or a hydraulic pile driver for generating impact loading for hammering down or driving in piles, boards, or supports. A vibration hammer or a piling unit may also be provided in combination with a drilling drive in principle.

According to a development, a particularly high use value of the construction device according to the invention is achieved in that an auxiliary winch beam is provided on an upper end of the leader element above the at least one GPS receiving unit. The auxiliary winch beam may be designed as a so-called mast head comprising deflection rollers for at least one auxiliary cable, which is driven by a winch on the mast or the carrier device. Additional lifting tasks, for example for raising a drilling tool, drill-pipe element, pile, etc., can be carried out by means of the auxiliary cable.

It is particularly advantageous here for the auxiliary winch beam to be mounted on the leader element rotatably about a vertical rotational axis. In this case, an angle of rotation is limited and coordinated with an antenna assembly of the GPS receiving units such that the auxiliary cable hanging vertically downwards does not collide with the GPS receiving units or the antenna assembly. A rotation can be carried out by means of a rotary drive.

In accordance with the construction device being equipped with a corresponding working device or working unit, according to a development of the invention, it is preferred for the construction device to be a drilling device, a vibration device, or a piling device. However, the invention is not limited to these preferred embodiments of a construction device. Instead, the invention can also be used in all other construction devices comprising a mast in which a precise positioning by means of GPS receiving units is desired.

The object stated at the outset is further described by a method for operating a drilling device according to the invention, wherein, by means of the at least one GPS receiving unit, a first position measurement will be taken in an upper, first measuring position in which the movement element is moved into an upper position on the mast and a second position measurement will be taken in a lower, second measuring position in which the movement element is moved into a lower position on the mast.

This method can be carried out using the above-described construction device, with the above-described advantages being achieved. In particular, by means of the method according to the invention, when the GPS receiving unit is arranged in the upper, first measuring position an adjustment of the construction device can be carried out, for example when approaching a drilling point. If a drilled hole or a foundation element is then constructed in the ground by means of the construction device, a precise measurement and positioning of the element thus constructed can be carried out with increased accuracy by means of the at least one GPS receiving unit if this unit is located in a lower, second measuring position close to the element or the working point.

The invention is explained in the following with reference to preferred embodiments, which are shown schematically in the accompanying drawings, in which.

Figure 3:
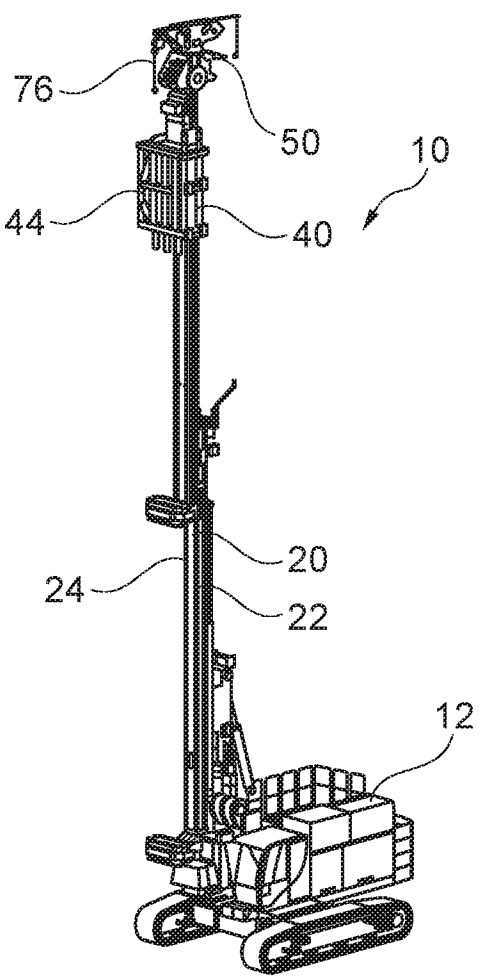
FIG. 3 is a perspective view of the construction device from FIG. 1 and FIG. 2.
Figure 2:
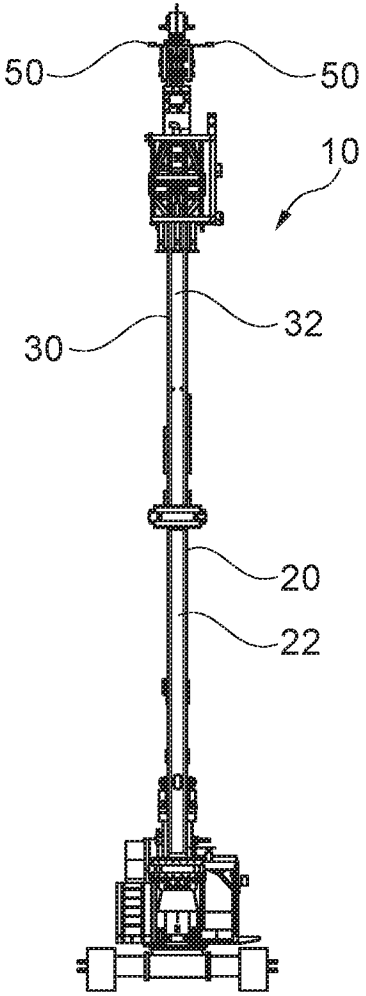
FIG. 2 is a front view of the construction device from FIG. 1.
Figure 1:
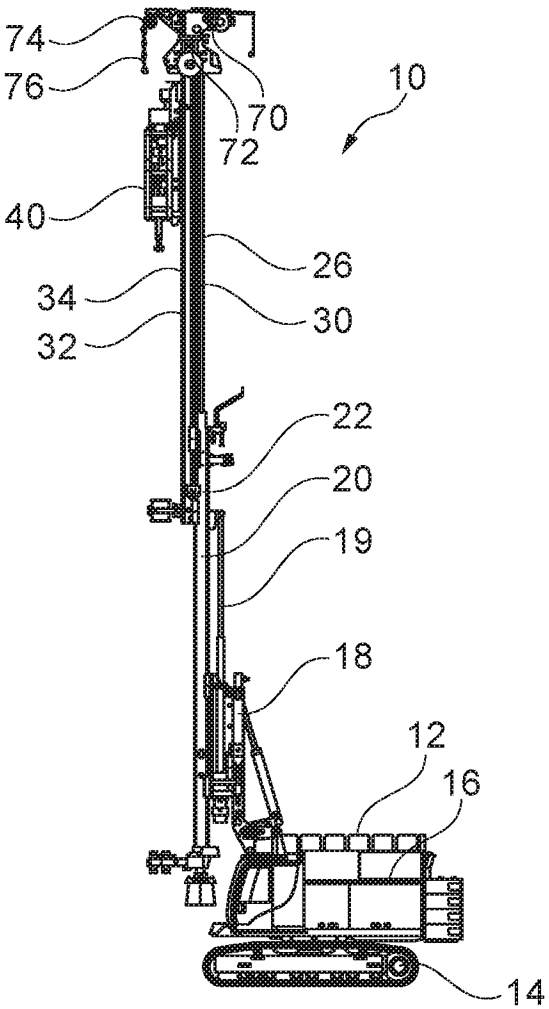
FIG. 1 is a side view of a construction device according to the invention having the leader element moved upwards.

A construction device 10 according to the invention, which is designed as a drilling device, is shown schematically in FIG. 1 to 3. The construction device 10 comprises a carrier device 12, which comprises a crawler chassis 14. A superstructure 16 comprising an operator's cab and the drives is rotatably mounted on the crawler chassis 14. A mast 20 or a mast assembly is adjustably arranged in a front region of the superstructure 16 by means of an articulated mechanism 18 that is known in principle.

In the embodiment shown, the mast 20 consists of a beam-shaped vertical main mast 22, which can be vertically moved by means of a movement cylinder 19 relative to the articulated mechanism 18. The mast 20 can be transferred into a substantially horizontal position on the carrier device 12 by means of the articulated mechanism 18.

The main mast 22 of the mast 20 comprises a linear guide 24 on its front side, along which guide a movement element 30 is mounted vertically movably by means of an actuating cylinder 26. In the embodiment shown, the movement element 30 is designed as a beam-shaped leader element 32, such that the mast 20 or the mast assembly forms a so-called leader.

A linear slide guide 34 is formed even on the front side of the beam-shaped leader element 32 that is movable along the main mast 22. A slide 40 which can receive a working device 44 is mounted movably along the slide guide 34. In the embodiment shown, the working device 44 is designed as a drilling device comprising three output shafts.

An auxiliary winch beam 70 is mounted on the upper end or head region of the leader element 32 by means of a beam bearing 72 rotatably about a vertical rotational axis. At least one deflection roller 74 is arranged on the auxiliary winch beam 70, via which roller an auxiliary cable 76 is provided for special lifting tasks, for example for raising a drill pipe.

Two GPS receiving units 50 according to the invention are attached laterally to the upper end region of the leader element 32, below the auxiliary winch beam 70. The GPS receiving units 50 are designed to receive GPS signals and serve to the positioning in an existing GPS system.

In FIG. 1 to 3, the leader element 32 is moved upwards relative to the main mast 22, such that the two GPS receiving units 50 are located in an upper, first measuring position. In this upper, first measuring position, a very good reception of a GPS signal is generally ensured, and therefore, in this position, it is in particular provided to approach a working point.

Figure 6:
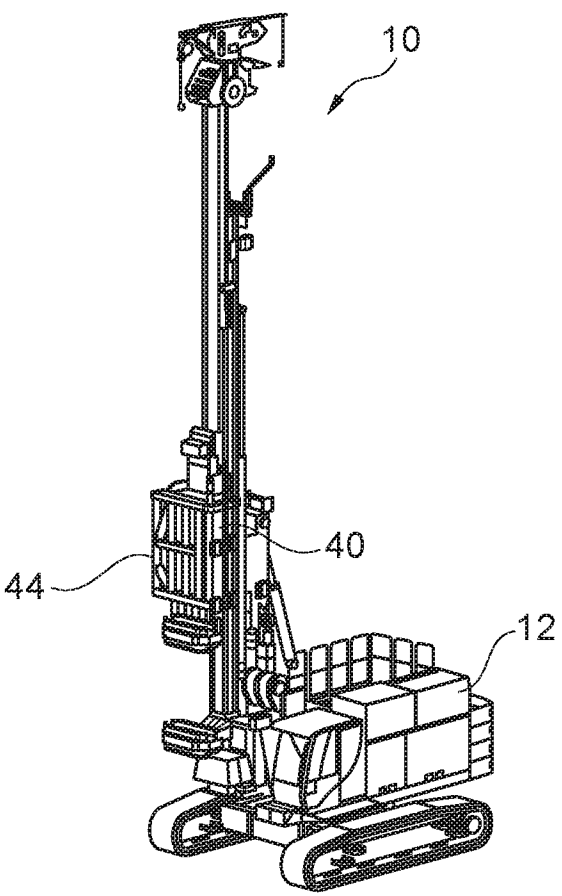
FIG. 6 is a perspective view of the construction device from FIG. 4 and FIG. 5.
Figure 5:
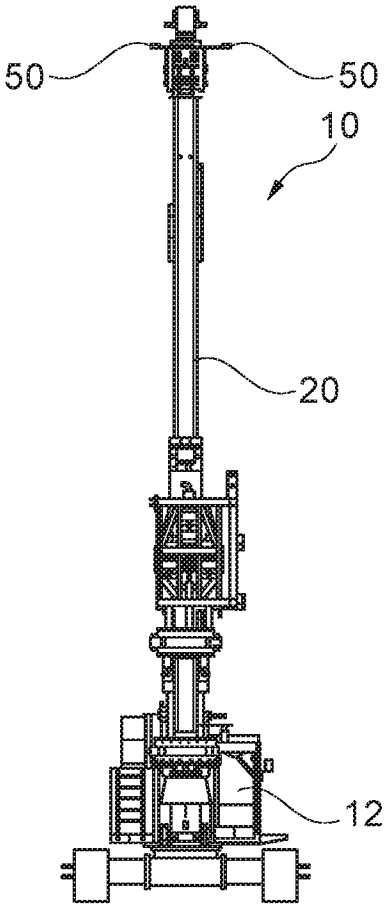
FIG. 5 is a front view of the construction device from FIG. 4.
Figure 4:
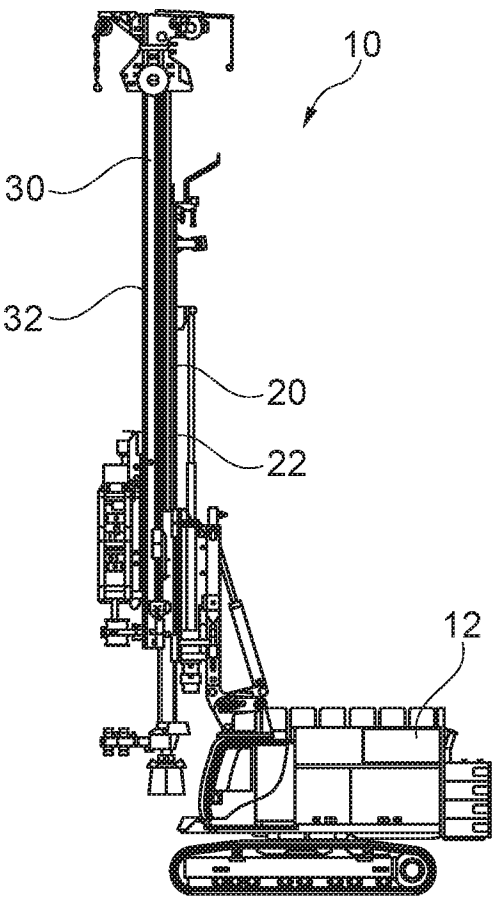
FIG. 4 is a side view of the construction device from FIG. 1 to 3 having the leader element moved downwards.

FIG. 4 to 6 show the construction device 10 according to the invention from FIG. 1 to 3, but at which the movement element 30 designed as the leader element 32 is moved downwards relative to the main mast 22. Depending on the travelling distance on the main mast 22, which may be up to 10 meters or more, the two GPS receiving units 50 are from now on located closer to the ground and thus closer to the actual processing point of the construction device 10. When constructing a foundation element, such as a foundation pile, or a drilling hole, for example, in this lower, second measuring position, a determination of the position of a working point can thus be executed particularly precisely by means of the GPS receiving units 50. In this retracted position of the mast 20, bearing play and unavoidable deflections of the mast 20, which may occur due to wind load for example, are also considerably reduced, and this contributes to an improvement in the position measurement.

At the same time, according to FIG. 4 to 6, the slide 40 is also moved downwards into a position close to the ground, together with the working device 44, along the beam-shaped leader element 32.

Figure 7:
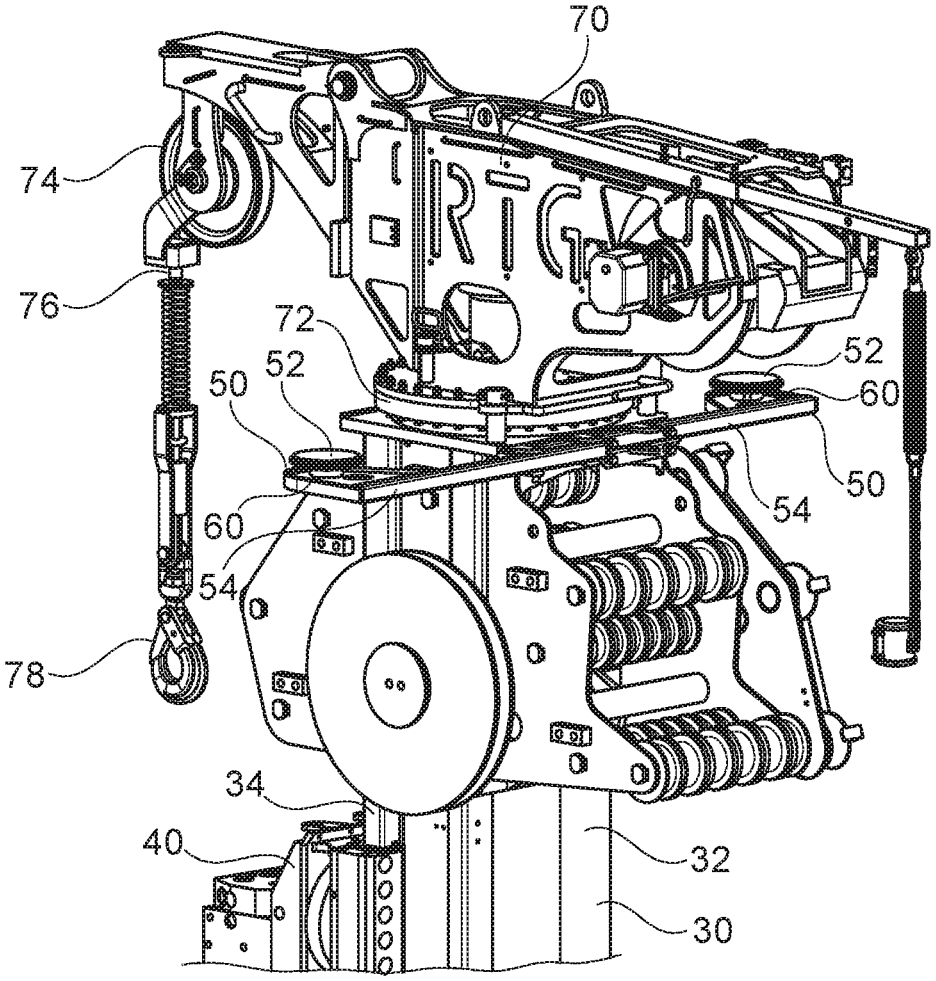
FIG. 7 is a perspective, enlarged view of an upper region of the leader element of the construction device from FIG. 1 to 6.

An upper end region of the movement element 30 of the mast assembly 20, which is designed as a leader element 32, is shown in an enlarged view in FIG. 7. In this case, an approximately T-shaped auxiliary winch beam 70 comprising two lateral booms is arranged at an upper end of the beam-shaped leader element 32 via a horizontal rotatable beam bearing 72. A deflection roller 74 for an auxiliary cable 76 is rotatably mounted on one end of a boom on the front side of the leader element 32. A load hook 78 for lifting tasks is attached to the free end of the auxiliary cable 76.

A slide guide 34 for the slide 40 is formed on a front side of the beam-shaped leader element 32. The slide 40 comprising the working device (not shown in FIG. 7) can be moved vertically along the leader element 32 by means of an actuating cylinder or a cable assembly (not shown).

Two GPS receiving units 50 according to the invention are attached with in each case one bar-shaped antenna holder 54 to the upper end region of the leader element 32, below the beam bearing 72 of the auxiliary winch beam 70. The two bar-shaped antenna holders 54 extend laterally to opposite sides of the leader element 32.

A receiving element 52 for the GPS signals comprising the corresponding electronics is arranged at the respectively free end of the antenna holder 54 by means of a planar receptacle 60. Owing to the antenna holders 54, the receiving elements 52 are arranged spaced apart from the leader element 32 and the auxiliary winch beam 60, so that as a result a good reception of the GPS signals is achieved.

The antenna holders 54 are arranged in a rear region of the leader element 32 in such a manner that a collision with the auxiliary cable 76 comprising the load hook 78 is prevented when the auxiliary winch beam 70 pivots by at least 90°.

Figure 8:
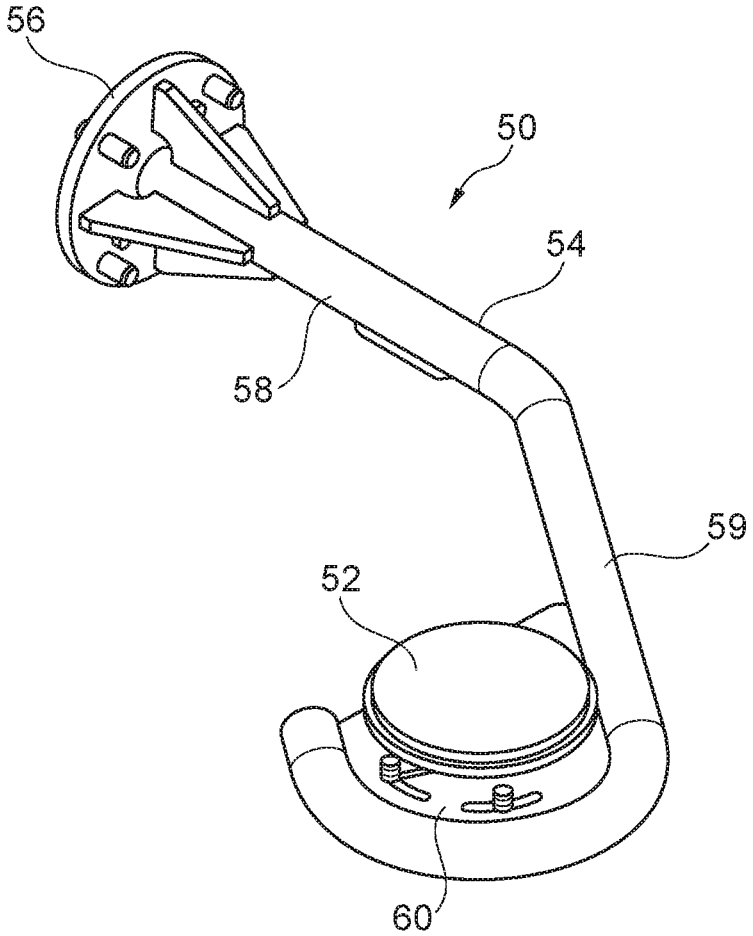
FIG. 8 is an enlarged view of a modified GPS receiving unit according to the invention.

A modified GPS receiving unit 50 is shown in FIG. 8. Here, the bar-shaped or rod-shaped antenna holder 54 has a straight first bar portion 58. A planar fastening flange 56 for detachably attaching the GPS receiving unit 50 to the movement element 30 is provided on the free end of the first bar-shaped portion 58.

A second bar-shaped portion 59 of the antenna holder 54 is joined to the first bar-shaped portion 58 at an obtuse bend angle. The second bar-shaped portion 59 is curved in an approximate semi-circle at its free end and receives a planar receptacle 60 in the curved region, to which the actual receiving element for receiving the GPS signals is attached. The antenna holder 54 may be designed as a hollow tube, such that a line for power-supply and data-communication can be arranged within the bar-shaped holder.

The invention claimed is:

1. A construction device, comprising:

a carrier device, an approximately vertical mast, which is mounted on the carrier device, a movement element, which is vertically movable along a linear guide on the mast, and at least one global positioning system (GPS) receiving unit, which is arranged in a region of the mast, characterized in that the movement element is a beam-shaped leader element, in that the at least one GPS receiving unit is attached in an upper region of the leader element, in that the leader element comprises a linear slide guide on a front side facing away from the mast, in that a slide is provided which is mounted vertically movably along a slide conveyor of the leader element, and in that the at least one GPS receiving unit is configured to move between an upper, first measuring position and a lower, second measuring position by means of the leader element.

2. The construction device according to claim 1, characterized in that two GPS receiving units are provided, which are arranged on opposite sides of the movement element.

3. The construction device according to claim 1, characterized in that the at least one GPS receiving unit comprises an antenna holder extending approximately horizontally away from the movement element, wherein a free end of the antenna holder includes a receiving element spaced apart from the movement element.

4. The construction device according to claim 3, characterized in that the antenna holder comprises a first rod-shaped portion and a second rod-shaped portion, which are arranged angled with an obtuse bend angle relative to one another.

5. The construction device according to claim 1, characterized in that a working device, selected from a drilling drive, a vibration hammer or a piling unit, is arranged on the slide.

6. The construction device according to claim 1, characterized in that an auxiliary winch beam is provided on an upper end of the leader element above the at least one GPS receiving unit.

7. The construction device according to claim 6, characterized in that the auxiliary winch beam is mounted on the leader element rotatably about a vertical rotational axis.

8. The construction device according to claim 1, characterized in that the construction device is a drilling device, a vibration device or a piling device.

9. A method for operating a construction device according to claim 1, the method comprising the steps of:

taking a first position measurement with the at least one GPS receiving unit, the first position measurement is taken in the upper, first measuring position in which the leader element is moved into an upper position on the mast; and taking a second position measurement with the at least one GPS receiving unit, the second position measurement is taken in the lower, second measuring position in which the leader element is moved into a lower position on the mast.

* * * * *